US006273712B1

(12) United States Patent
Rach et al.

(10) Patent No.: US 6,273,712 B1
(45) Date of Patent: Aug. 14, 2001

(54) EQUINE DENTAL GRINDING APPARATUS

(76) Inventors: Dennis J. Rach, 35 Silvergrove Ct., N.W., Calgary, Alberta (CA), T3B 5A3; W. Bruce G. Herron, 207 Silverhill Way, N.W., Calgary, Alberta (CA), T3B 4K9

( * ) Notice: Subject to any disclaimer, the term of this patent is extended or adjusted under 35 U.S.C. 154(b) by 0 days.

(21) Appl. No.: 09/401,333

(22) Filed: Sep. 23, 1999

(51) Int. Cl.[7] ..... A61D 5/00
(52) U.S. Cl. ..... 433/1; 433/125; 433/116
(58) Field of Search ..... 433/1, 125, 166, 433/130, 134, 116

(56) References Cited

U.S. PATENT DOCUMENTS

| | | | | |
|---|---|---|---|---|
| 771,311 | * | 10/1904 | Kille | 433/1 |
| 792,666 | * | 6/1905 | Reed et al. | 433/1 |
| 925,379 | * | 6/1909 | Reed et al. | 433/1 |
| 4,722,685 | | 2/1988 | de Estrada . | |
| 5,915,966 | * | 6/1999 | Miller | 433/125 |

OTHER PUBLICATIONS

Brochure—Swissvet Veterinary Products "swissfloat™" Electric Toothfloat for Horses Swissmade by Eisenhut–Vet.

* cited by examiner

*Primary Examiner*—Nicholas D. Lucchesi
(74) *Attorney, Agent, or Firm*—Jones, Tullar & Cooper, P.C.

(57) ABSTRACT

A dental appliance or apparatus for grinding the teeth of equine patients includes a variable speed motor and an elongated tube leading from the motor to a head member that mounts an annular disk-shaped grinding wheel that has a planar grinding surface thereon. The head member also mounts a cup-shaped guard member that has a skirt portion extending beyond the grinding surface of the grinding wheel so as to protect the tongue and mucosa of the patient during the grinding operation. The elongated tube permits the grinding wheel to be inserted into the horse's mouth to bring it into close proximity to teeth needing to be ground and the grinding wheel can be easily oriented relative to the teeth to be ground since it can be rotated through several angles relative to the motor to reach both upper and lower sets of teeth. A drive shaft couples the grinding wheel to the motor, is contained within the elongated tube, and is connected to the motor through a clutch assembly. Should the horse bite down on the grinding wheel and stop its rotation the clutch will prevent the motor from stalling or from twisting in the operator's hand. A water cooling accessory can be provided to spray cooling water directly at the grinding surface. By using this apparatus a more effective grinding operation can be performed and there is less danger of damage to the inner walls of the horse's mouth or to its tongue than with conventional grinding or filing techniques.

17 Claims, 2 Drawing Sheets

EQUINE DENTAL GRINDING APPARATUS

The present invention relates to a dental appliance or apparatus that is especially adapted for grinding the teeth of horses.

BACKGROUND OF THE INVENTION

Most animals require dental attention from time to time and many appliances have been developed to facilitate dental work on animals, and in particular on horses. The teeth of horses often develop spikes or sharp edges and these must be removed in order to prevent damage to the inside walls of the horse's mouth or to its tongue. When a horse must have a bit in its mouth there will be some damage to the teeth that must be kept in check. Typically a veterinarian will use a file to file away the spikes or sharp edges and that can be an awkward and tiring procedure. The veterinarian must keep the horses's mouth open and he must manoeuver the file within the mouth to perform his filing operation. Very often the spike or sharp edge is near the back of the horse's mouth and it can be very difficult to reach into the depths of the mouth and still do an effective job without damaging the interior walls (mucosa) of the mouth.

There is a need for a dental appliance or tool that will make the filing or grinding job easier and safer. One such device is described in U.S Pat. No. 4,722,685 of Feb. 2, 1988, issued to Juan M. de Estrada. That patent teaches an elongated hollow tube that carries a drive shaft driven by an electric motor. At one end the shaft mounts a dental bur that is rotated by the drive shaft and which is used to grind away the spikes or sharp edges on the horse's teeth. The dental bur is cylindrical, with a cylindrical grinding surface. The tube acts as a handle for the operator which means that it must be held like a wand as it is inserted into the horse's mouth. This is an awkward manoeuver for the operator and can be very tiring as he tries to work on upper and lower teeth and in particular the teeth at the back of the horse's mouth. Furthermore, the cylindrical nature of the dental bur means that it is difficult to effectively grind sharp spikes that are narrower than the diameter of the bur and that it is difficult to grind a smooth flat surface on any particular tooth in view of the cylindrical nature of the bur. The rotary bur tends to "jump" sideways while the operator is attempting to grind the teeth that are in a longitudinal row. There is additional difficulty in maneuvering the tube for grinding upper and lower teeth in the horse's mouth. Furthermore, the motor operates at a constant speed and does not allow flexibility for the operator when faster or slower speeds are needed for different areas of the mouth or for different tooth conditions. Thus, while the tool of this patent has some meritorious features, it also has drawbacks which render it somewhat ineffective for fine grinding of a horse's teeth.

SUMMARY OF THE INVENTION

The present invention meets the need for a good, effective dental appliance or apparatus that facilitates the operation of grinding the teeth of an equine patient. It improves on the principles of the tool described in U.S. Pat. 4,722,685 by providing a better handle for the operator and by providing an improved head portion that accommodates a disk-like grinding wheel that has a planar, annular or circular, grinding surface. The rotational axis of the grinding wheel is at 90° to the axis of the drive shaft and thus a flat grinding surface is presented to the tooth to be worked on. Additionally, the head portion can be rotated through 45° to 180° relative to the tube of the apparatus to facilitate grinding operations on lower and upper teeth within the horse's mouth. These adjustments allow the operator to better position the grinding wheel without requiring him to twist or manoeuver the apparatus to awkward positions relative to the horse's mouth, meaning that both the operator and the patient are not stressed as much as they might have been without the benefits of the present invention.

Broadly speaking, and in summary of the above, the present invention may be considered as providing dental apparatus for grinding teeth of equine patients comprising: a hand-held variable speed electrical motor including means for connecting the motor to a source of electricity and means for controlling the speed of the motor; and a grinding tool including: hollow cylindrical tube means connected at a proximal end thereof to the motor; shaft means connected at a proximal end thereof to the motor for rotation thereby, the shaft means extending within the tube means from the proximal end thereof to the distal end thereof; a head member connected to the distal end of the tube means; means for allowing the tube means and the head member to rotate through an angle of at least 45° on the axis of the tube means; a disk-like grinding wheel rotatably mounted within the head member, the wheel including a planar grinding surface thereon, the grinding wheel having an axis of rotation that is at an angle of 90° relative to the axis of the tube means; cup-shaped guard means attached to the head member, enclosing all but the grinding surface of the grinding wheel; and drive means within the head member for transmitting rotation of the shaft means at the distal end thereof through 90° to the grinding wheel.

DESCRIPTION OF THE PREFERRED EMBODIMENT

Figure 1:
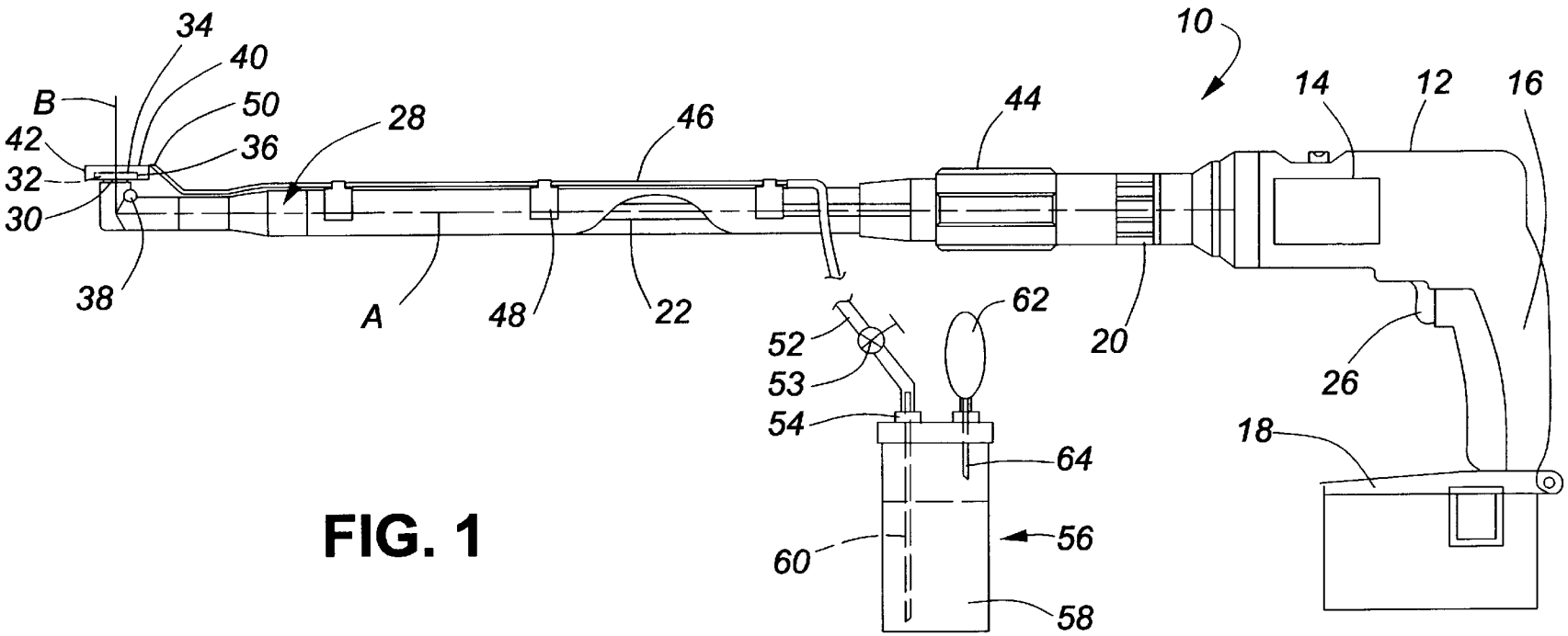
FIG. 1 is a side elevation of the dental apparatus of this invention.
Figure 2:
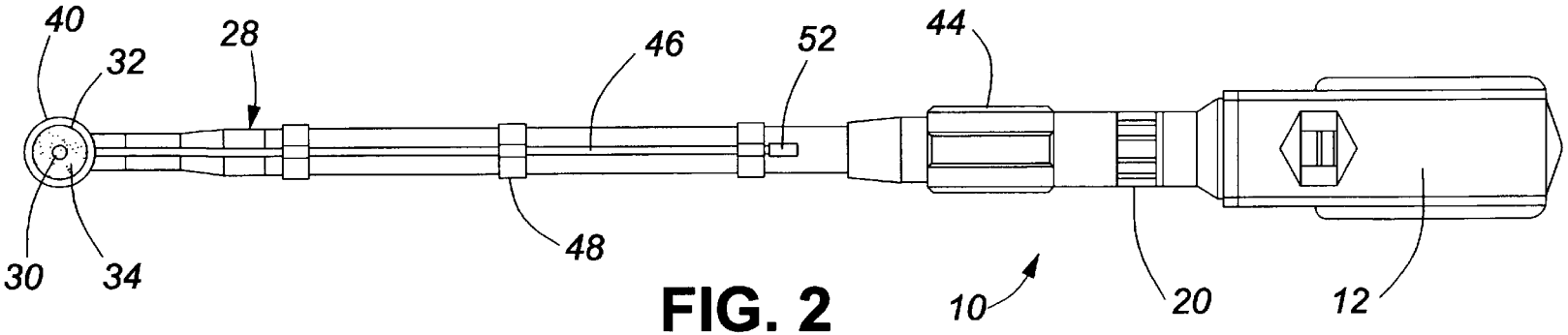
FIG. 2 is a top plan view of the dental apparatus of this invention.

FIG. 1 illustrates the dental apparatus 10 of the present invention in elevation. Therein it is seen that the apparatus 10 comprises a variable speed electrical motor 12. The motor 12 is preferably a commercially available AC (alternating current) or DC (battery operated) motor capable of rotation at speeds up to about 4000 RPM (revolutions per minute). One such commercially available motor is a model 875 Drywall Screw Driver available from the Porter-Cable Corporation. That motor includes a main body 14, a pistol grip 16 and a removable, rechargeable battery pack 18. If an AC motor were to be used it would come equipped with a power cord which terminates at a plug for insertion into a standard AC outlet. Needless to say, a DC powered apparatus would be more versatile in that it would not be dependent on having an AC outlet close to hand.

The motor 12 provides rotation, through a clutch assembly 20 that is included with the motor, to a drive shaft 22 contained within a hollow tube member 24 connected at a proximal end thereof to the clutch assembly. The pistol grip portion 16 of the motor is shaped to fit, generally, the hand of an operator, so that he or she will not be uncomfortable while using the apparatus of the present invention. The pistol grip portion includes therewithin a push button control switch 26 that is connected to the variable speed motor 12. By operating the push button 26 the operator is able to control the speed at which the motor 12 drives the drive shaft assembly 22. The tube member 24 has a length of about 10 to 40 cm so that the distal end of the tube member can reach within the mouth of a horse to the teeth at the back of the mouth while the motor is outside the mouth at a comfortable distance therefrom.

At the distal end thereof the tube member 24 mounts a head member 28. The drive shaft 22 which is contained within the hollow tube member 24 is connected at its distal end via a bevel gear set (not shown) to a drive shaft 30 which in turn carries a grinding wheel 32 thereon, the axis B of the grinding wheel being normal to the axis A of the elongated tube 24. The grinding wheel 32 is disk-shaped and has a planar grinding surface 34 that can be annular or circular in shape. Preferably the grinding surface comprises very small chips of tungsten-carbide soldered to the surface of the wheel or embedded in an adhesive matrix thereon. Although not essential, the grinding wheel may also have a peripheral grinding edge 36. The grinding wheel should be commercially available and it will be readily mountable on, or is integral with, the drive shaft 30.

The tube member 24 may be constructed from a small diameter (e.g. 22 mm) length of stainless steel pipe; and the head member 28 should be commercially available. One such head assembly is the model #817 90° Angle Head Assembly available from U.S. Industrial Tool & Supply Company of Plymouth, Michigan, U.S.A. As seen in FIG. 1 the head assembly 28 includes a grease fitting 38 via which grease can be fed to the drive shaft of the head assembly as required for lubrication.

Figure 3:
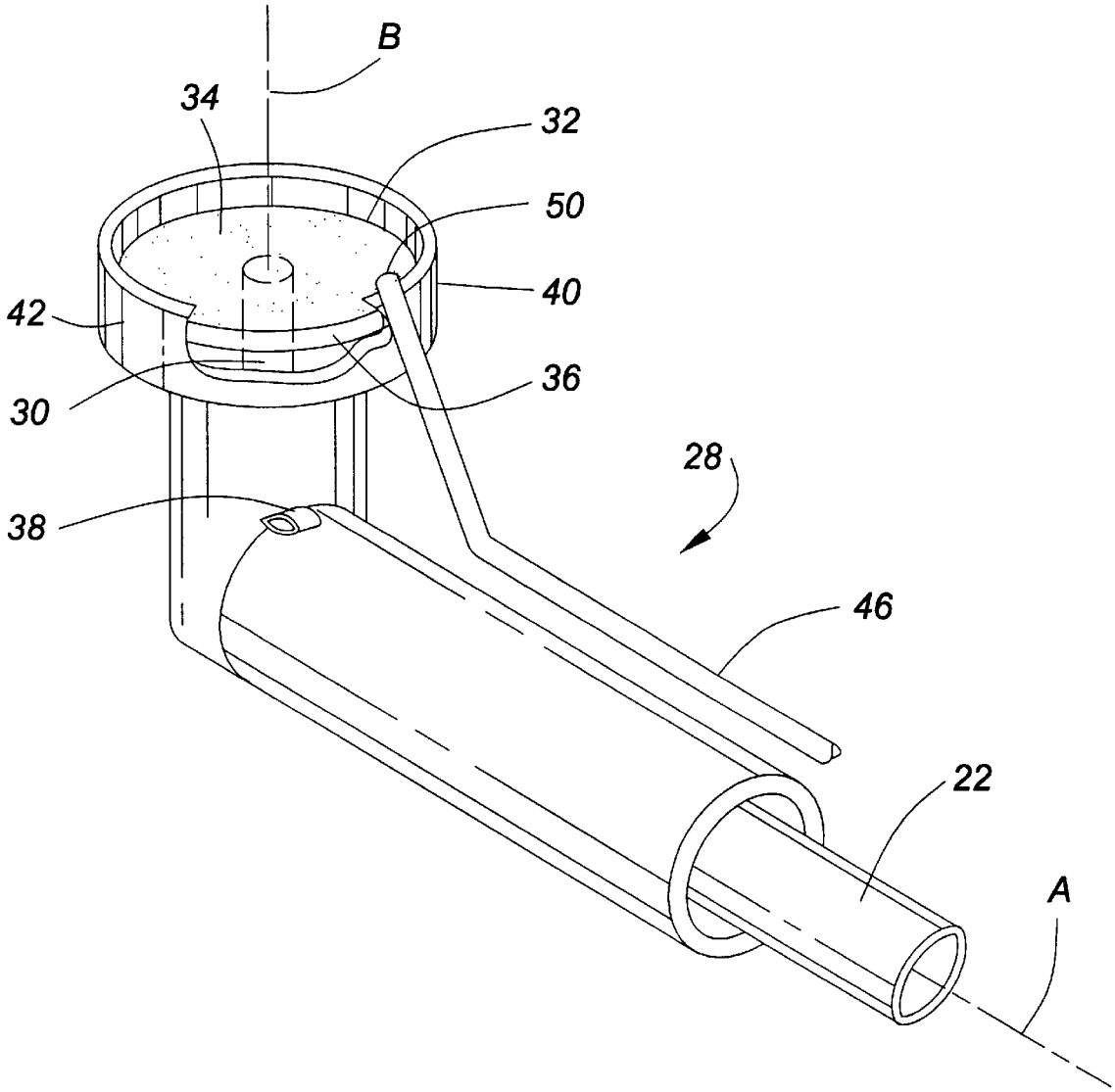
FIG. 3 is an enlarged partial perspective view of the head member of the dental apparatus of this invention.

A stainless steel cup-shaped guard member 40 is attached to the head member 28 so that an annular skirt portion 42 thereof encloses or surrounds the periphery of the grinding wheel 32. In fact the skirt portion preferably extends beyond the grinding surface 34 so that, in effect, the grinding surface is recessed below the outermost edge of the skirt portion. The skirt portion 42 will protect the tongue or mucous membrane of the horse's mouth from contact with the grinding wheel while the apparatus of this invention is in use. As seen in FIG. 3 the guard and the grinding wheel are quite small in diameter, a feature which, along with the narrow width of the head member permits, the dental apparatus of the invention to reach rearmost areas of the horse's mouth for grinding of the rearmost teeth.

In use, the operator will hold the pistol grip portion 16 of the motor 12 with a finger adjacent the push button 26 and will direct the head member 28 at the end of tube member 24 into the mouth of his equine patient. The operators other hand can grip the tube member 24 to guide the grinding wheel to the desired location in the horse's mouth. The push button when activated will cause the motor 12 to rotate the shaft 22 through the clutch assembly 20 at a speed dependent on the pressure applied to the push button, the shaft in turn rotating the disk-like grinding wheel 32 through the 90° bend available through the bevel gear set. The grinding wheel then is used to grind or file the teeth of the equine patient to alleviate the problems of note. Should the horse bite or clamp down on the grinding wheel so as to stop it from rotating, the clutch assembly 20 will prevent the motor from stalling or from twisting in the operator's hand. In order to work on the teeth of the upper jaw the head portion 28 would be oriented as in FIG. 1 with the grinding wheel facing upwardly. To work on the teeth of the lower jaw the collar or sleeve 44 at the clutch assembly 20 would be activated so that the grinding surface 32 of the grinding wheel 28 is facing downwardly. In order to work on side surfaces of the teeth when necessary the operator can rotate the head member 28 through 45° so as to provide the grinding surface 34 with an appropriate angle of attack. The sleeve 44 will cooperate with detents within the clutch assembly so that the tube member 24 can rotate on its axis A through angles of 45°, 90°, 135° and 180° relative to the motor.

FIG. 1 illustrates another feature of this invention, namely the provision of cooling water to improve the comfort level of the equine patient and also to improve the grinding function through water lubrication. A small diameter length of stainless steel tubing 46 extends along the tube member 24 and is held thereagainst by a plurality of clamps 48. The tubing 46 is bent towards the grinding wheel 32 and the distal end 50 of the tubing is formed as a nozzle that is directed generally towards the grinding surface 34 of the grinding wheel 32. The proximal end of the tubing 46 is connected to a length of flexible plastic or rubber tubing 52 that in turn is connected via a hand-operated valve 53 to the inlet 54 of a hand pump 56. The pump 56 includes a cylindrical housing 58, a suction tube 60, a squeeze bulb 62, and a pressure tube 64. In use, the housing 58 is filled with cool water and while the grinding operation is underway the operator, or an assistant, can squeeze the bulb 62 to pressurize the housing and thereby force water through the suction tube 60. The operator can turn the valve 53 to control the flow of water through the tubes 52 and 46 so that water sprays from the nozzle 50 at the distal end of the tubing 46, towards the area being ground by the grinding wheel 32.

It is clear that the grinding apparatus of the present invention improves the ability of a veterinarian to grind or file the teeth of an equine patient, by using a flat grinding surface that provides a better effect than a cylindrical grinding bit or bur. By having a head portion that can be rotated relative to the mounting tube the operator can reach more zones of the horse's mouth without having to move his arm to awkward positions relative to the horse's head and as a consequence the operator will not become as tired as he might otherwise become and the horse will not be inconvenienced nearly as much, making for a more contented patient. The end result will be a better and faster dental operation on the equine patient.

The foregoing has described a preferred embodiment of the present invention. It is expected that a skilled artisan could modify the structure of the present invention without departing from the spirit thereof and accordingly the protection to be afforded this invention is to be determined from the scope of the claims appended hereto.

What is claimed is:

1. Dental apparatus for grinding teeth of equine patients comprising: a hand-held variable speed electrical motor including means for connecting the motor to a source of electricity and means for controlling the speed of said motor; and a grinding tool including: hollow cylindrical tube means connected at a proximal end thereof to said motor; shaft means connected at a proximal end thereof to said motor for rotation thereby, said shaft means extending within said tube means from said proximal end thereof to the distal end thereof; a head member connected to said distal end of said tube means; means for allowing said tube means and said head member to rotate through an angle of at least 45° on the axis of said tube means; a disk-like grinding wheel rotatably mounted within said head member, said grinding wheel including a planar grinding surface thereon, said grinding wheel having an axis of rotation that is at an angle of 90° relative to the axis of said tube means; cup-shaped guard means attached to said head member, enclosing all but the grinding surface of said grinding wheel; and drive means within said head member for transmitting rotation of said shaft means at the distal end thereof through 90° to said grinding wheel.

2. The dental apparatus of claim 1 wherein said motor includes a pistol grip portion, said switch means for controlling the speed of said motor being housed within said motor and including a push button switch projecting forwardly from said pistol grip portion.

3. The dental apparatus of claim 2 including clutch means interconnecting said motor and said shaft means.

4. The dental apparatus of claim 3 wherein said means for allowing said head means to rotate includes a sleeve member connected to said tube means and to said clutch means, said sleeve member including detent means and locking means to permit said tube means and said head member to rotate to angles of 45°, 90°, 135° and 180° on the axis of said tube means relative to said motor.

5. The dental apparatus of claim 4 wherein said guard means is generally cylindrical in shape, including an annular skirt portion that surrounds said grinding wheel and extends axially beyond the wheel.

6. The dental apparatus of claim 5 including a grease fitting on said head member for receiving lubricating grease for said grinding wheel and a shaft to which said grinding wheel is mounted.

7. The dental apparatus of claim 6 including means for spraying cooling water at said grinding wheel during operation thereof.

8. The dental apparatus of claim 7 wherein said spraying means comprises a water container, means for pressurizing said water container, a length of stainless steel tubing extending along said tube means and terminating at a distal end thereof at a spray nozzle adjacent said grinding wheel, a length of flexible tubing at the proximal end of said tubing and leading to said water container, and valve means in said flexible tubing, whereby, with said container pressurized, water from within the container will flow along said flexible tubing and said stainless steel tubing to be sprayed from said nozzle towards said grinding wheel under control of said valve means.

9. The dental apparatus of claim 8 including a plurality of clamp members mounting said stainless steel tubing to said tube means.

10. The dental apparatus of claim 1 wherein said grinding surface is annular in configuration and comprises a matrix of tungsten-carbide chips embedded in an adhesive material.

11. The dental apparatus of claim 1 wherein said grinding surface is annular in configuration and comprises a matrix of tungsten-carbide chips soldered to an upper surface of said grinding wheel.

12. The dental apparatus of claim 1 wherein said grinding surface is circular in configuration and comprises a matrix of tungsten-carbide chips embedded in an adhesive material.

13. The dental apparatus of claim 1 wherein said grinding surface is circular in configuration and comprises a matrix of tungsten-carbide chips soldered to an upper surface of said grinding wheel.

14. The dental apparatus of claim 1 wherein said motor is a battery powered DC motor and said connecting means includes means for attaching a rechargeable battery pack to said motor.

15. The dental apparatus of claim 1 wherein said motor is an AC motor and said connecting means includes an electrical cord and plug means for insertion into an AC outlet.

16. Dental apparatus for grinding teeth of equine patients comprising: a hand-held variable speed DC electrical motor including means for connecting the motor to a rechargeable battery pack and means for controlling the speed of said motor; and a grinding tool including: hollow cylindrical tube means connected at a proximal end thereof to said motor; clutch means connected to said motor; shaft means connected at a proximal end thereof to said clutch means for rotation by said motor through said clutch means, said shaft means extending within said tube means from said proximal end there of to the distal end thereof; a head member connected to said distal end of said tube means; means for allowing said tube means and said head member to rotate through an angle of at least 45° relative to said motor on the axis of said tube means; a disk-like grinding wheel rotatably mounted within said head member, said grinding wheel including a planar grinding surface thereon, said grinding wheel having an axis of rotation that is at an angle of 90° relative to the axis of said tube means; cup-shaped guard means attached to said head member, enclosing all but the grinding surface of said grinding wheel; and drive means within said head member for transmitting rotation of said shaft means at the distal end thereof through 90° to said grinding wheel.

17. Dental apparatus for grinding teeth of equine patients comprising: a hand-held variable speed AC electrical motor including means for connecting the motor to an AC outlet and means for controlling the speed of said motor; and a grinding tool including: hollow cylindrical tube means connected at a proximal end thereof to said motor; clutch means connected to said motor; shaft means connected at a proximal end thereof to said clutch means for rotation by said motor through said clutch means, said shaft means extending within said tube means from said proximal end there of to the distal end thereof; a head member connected to said distal end of said tube means; means for allowing said tube means and said head member to rotate through an angle of at least 45° relative to said motor on the axis of said tube means; a disk-like grinding wheel rotatably mounted within said head member, said grinding wheel including a planar grinding surface thereon, said grinding wheel having an axis of rotation that is at an angle of 90° relative to the axis of said tube means; cup-shaped guard means attached to said head member, enclosing all but the grinding surface of said grinding wheel; and drive means within said head member for transmitting rotation of said shaft means at the distal end thereof through 90° to said grinding wheel.

* * * * *